United States Patent [19]

Abe et al.

[11] Patent Number: 4,666,123

[45] Date of Patent: May 19, 1987

[54] FIXTURE FOR MAKING RAILROAD TIES

[76] Inventors: Genji Abe, 1-3-15, Yotsuya, Fuchu-shi, Tokyo; Koichi Minegishi, 497 Kotta, Tama-shi, Tokyo, both of Japan

[21] Appl. No.: 732,498

[22] Filed: May 9, 1985

[51] Int. Cl.[4] ..... B28B 23/00

[52] U.S. Cl. ..... 249/86; 249/94; 249/97; 249/219 R

[58] Field of Search ..... 249/86, 94, 25, 211, 249/91, 93, 219 R, 177, 97; 238/349, 84, 85

[56] References Cited

U.S. PATENT DOCUMENTS 222,229 12/1879 Beals et al. ..... 249/94
2,669,763 2/1954 Unneland ..... 249/211
3,471,118 10/1969 Bormann et al. ..... 249/86
4,204,660 5/1980 Feuillade ..... 249/86
4,495,127 1/1985 Thim ..... 249/86

*Primary Examiner*—Jay H. Woo
*Assistant Examiner*—James C. Housel
*Attorney, Agent, or Firm*—James H. Tilberry

[57] ABSTRACT

The bottom of a concrete sleeper mold is formed with an opening, through which a rail fastening shoulder can be inserted. A pair of rotatable pieces are disposed beneath the mold on the opposite sides of the opening such that they face each other. These rotatable pieces are rotatable upwardly and downwardly. Their ends facing each other are formed with recesses, and they are spring biased by spring members in the circumferential direction of their support pins.

11 Claims, 3 Drawing Figures

FIXTURE FOR MAKING RAILROAD TIES

This invention relates to a device for positioning and for holding a rail fastening shoulder in place in a concrete railroad tie casting mold prior to and during pouring of concrete into the mold.

DESCRIPTION OF THE PRIOR ART

As a method of fastening a rail to a concrete railroad tie, it has been proposed that rail fastening springs be employed in lieu of rail fastening bolts.

In this method, the rail can be fastened to the railroad tie very quickly. However, a rail fastening shoulder is necessary for fastening the rail fastening springs to the concrete sleeper (See FIG. 3).

In the manufacture of a concrete railroad tie, the rail fastening shoulder is made integral with the tie by temporarily fastening it to a tie mold and then charging concrete into the mold. However, prior art temporary fastening means are very cumbersome and so unstable that the rail fastening shoulder may be misaligned while concrete is being charged.

OBJECTS OF THE INVENTION

An object of the present invention is to provide a device for temporarily holding the shank of a rail fastening shoulder in a concrete railroad tie mold.

In the device according to the present invention an opening is formed in the bottom of the mold, and rotatable pieces for holding the rail fastening shoulder are disposed on opposite sides of the opening.

The above-mentioned and other objects and features of the invention will become apparent from the following detailed description of the invention taken in conjunction with the drawings in which:

DESCRIPTION OF THE PREFERRED EMBODIMENTS OF THE INVENTION

Figure 1:
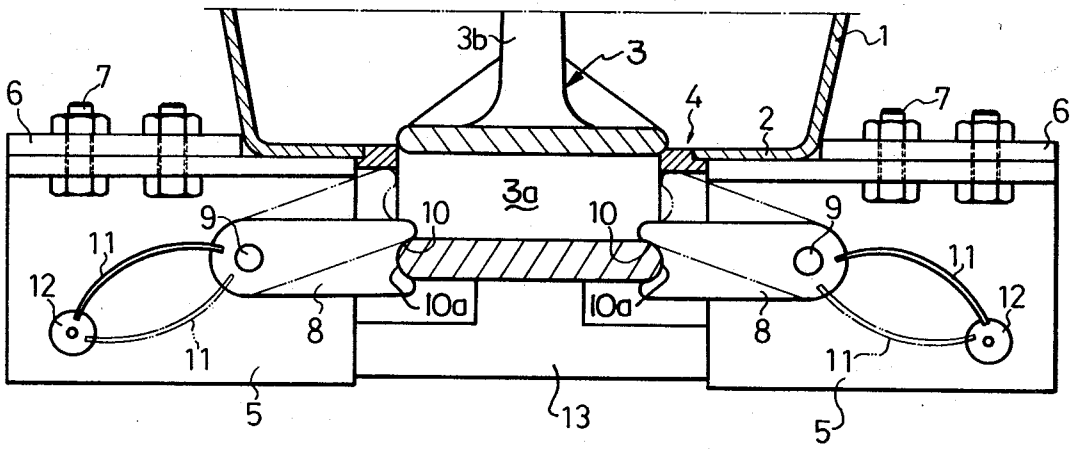
FIG. 1 is an elevational view, partially in section, of a preferred embodiment of the invention showing a railroad tie shoulder positioned within a concrete railroad tie mold and clamped in place.

Referring first to FIG. 1, there is shown a concrete railroad tie mold 1 having a bottom 2 formed with an opening 4. A rail fastening shoulder 3 is inserted inversely therethrough so as to position the shank **3*b* of the shoulder within the confines of the mold 1 and the sleeve 3*a*** of the shoulder on the top surface of the tie when cast.

Mold bottom 2 rests on mounting plates 5, which are positioned on opposite sides of the opening 4.

The mounting plates 5 are removably secured by bolts 7 to mold position plates 6 which are secured by means of welding to the opposite sides of the mold 1.

Rotatable pieces 8 are each pivotally secured by a pin 9 to an adjacent support plate 5.

Each rotatable piece 8 is provided with a groove 10 adapted to engage a peripheral edge **10*a* of shoulder sleeve 3*a***.

The upper ends of leaf spring members 11 are attached to the rear sides of the rotatable pieces 8 and the lower ends are secured to rotatable shafts 12 mounted on mounting plates 5. The rotatable pieces 8 are thus biased by the leaf springs 11 to snap over dead center into an upper position shown in phantom or into a lower position shown in solid lines.

Figure 3:
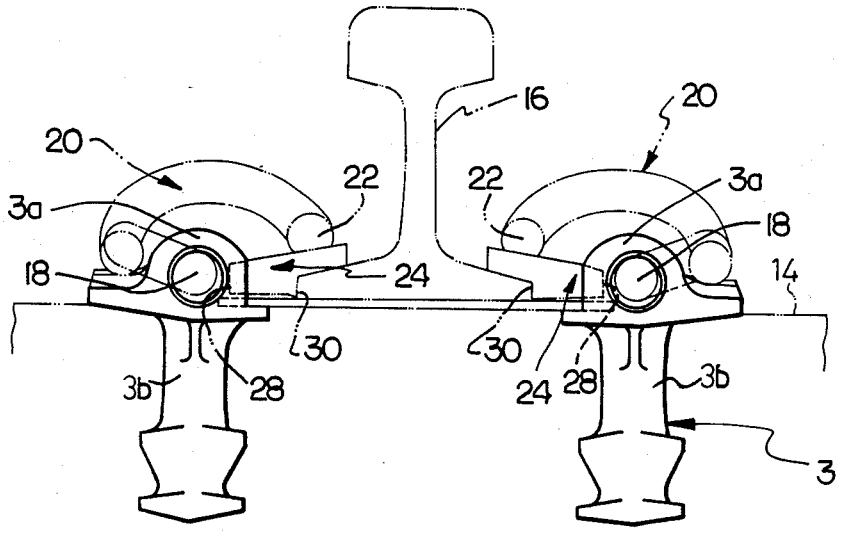
FIG. 3 is an elevational view of a pair of railroad tie shoulders embedded and positioned in a concrete railroad tie to anchor the ends of rail fastening springs whereby the opposite free ends of said rail fastening springs are placed in pressure contact with the opposite sides of the bottom flange of a rail.

A shoulder positioning block 13 is secured between mounting plates 5. In order to position a shoulder 3 in a mold 1, the shoulder is inverted and lowered into opening 4 until peripheral edges **10*a* of shoulder sleeve 3*a* engage grooves 10 of rotatable pieces 8. Downward pressure on shoulder shank 3*b* is applied to cause rotatable pieces 8 to pivot downwardly while leaf springs 11 are shifted beyond dead center, thereby causing rotatable pieces 8 to exert a downward thrust on shoulder sleeve 3*a* until coming to rest on positioning member 13. So positioned, shoulder sleeve 3*a* is substantially clear of mold 1, whereas shoulder shank 3*b* is entirely contained within mold 1. Concrete may now be poured into mold 1 without misaligned shoulders 3 because of the firm contact established between rotatable pieces 8, shoulder sleeve 3*a*, and positioning block 13. When the concrete hardens, the railroad tie 14 is removed from mold 1, ready for use. As shown in FIG. 3, shoulder sleeves 3*a* are secured to the top face of tie 14 equidistant from the center of rail 16. Ends 18 of compression springs 20 engage sleeves 3*a*, while ends 22 are in pressure engagement with plates 24. Plates 24 are shaped to make bearing contact with the opposite sides of rail lower flange 26 and also abut against shoulder sleeves 3*a* so that surfaces 28 and 30 of plates 24 locate and hold rail 16 in alignment on concrete tie 14**.

Figure 2:
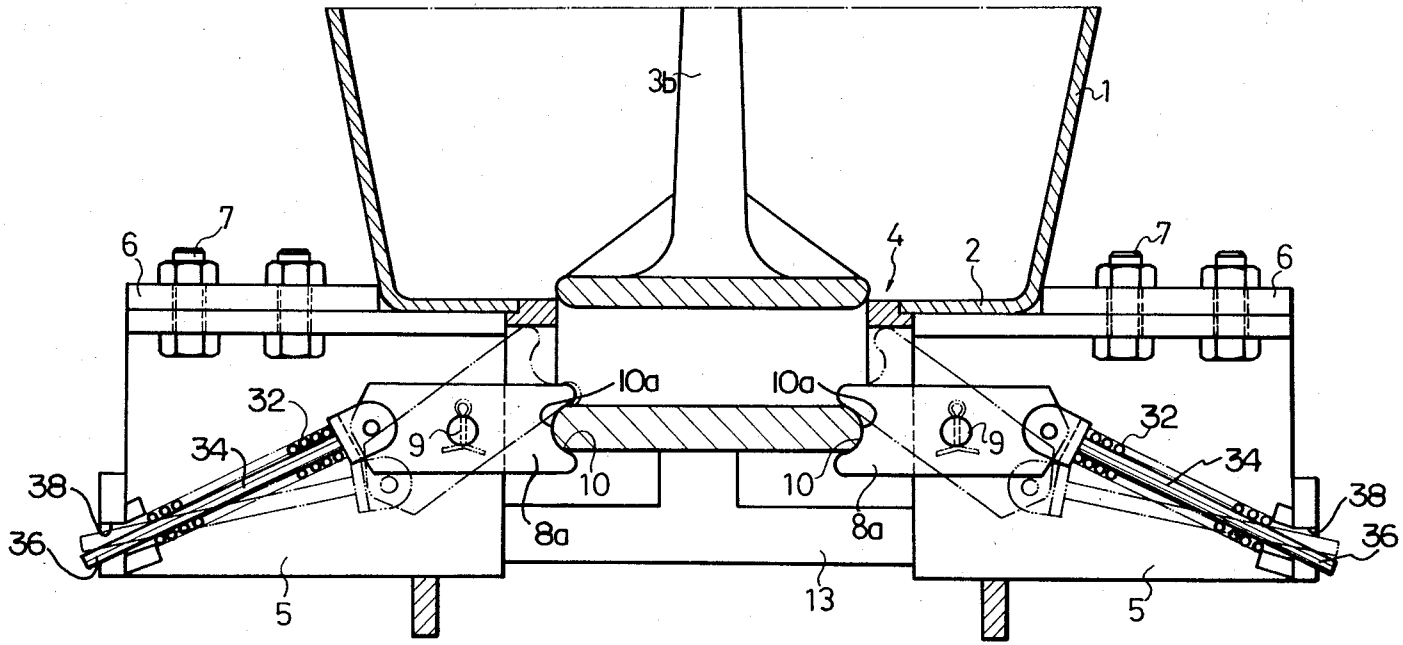
FIG. 2 is an elevational view, partially in section, of a second preferred embodiment of the invention showing a railroad tie shoulder positioned within a concrete railroad tie mold and clamped in place.

FIG. 2 shows a different embodiment of the present invention, in which compression springs 32 are employed in liew of leaf members 11 shown in FIG. 1. In this embodiment, rods 34 are pivotally secured to respective rotatable pieces **8*a*, which are in turn pivotally secured to respective support plates 5. The ends 36 of rods 34 are permitted to reciprocate in apertures 38 while shifting through dead center from the upper, or non-engaged, position of rotatable pieces 8*a* to the lower, or engaged, position of rotatable pieces 8*a*. Thus, the essential difference between the embodiment of the invention of FIG. 1 and the embodiment of the invention of FIG. 2 resides in the spring means 11 and 32, respectively. In all other respects, the embodiments of FIGS. 1 and 2 are substantially the same. In both embodiments, the rotatable pieces are automatically reset when the cast concrete tie 14 is lifted from the mold 1. As shoulder sleeve 3*a* moves upwardly through opening 4, peripheral edges 10*a*, while still engaged in recesses 10 of rotatable pieces 8*a*, pivot the recessed ends of rotatable pieces 8*a* upwardly until the compression springs 20 are snapped over dead center. Rotatable pieces 8*a*** are then repositioned and ready for the next shoulder sleeve engagement prior to another pour.

It will be understood that the above described embodiments of the invention are for the purpose of illustration only. Additional embodiments, modifications and improvements can be readily anticipated by those skilled in the art based on a reading and study of the present disclosure. Such additional embodiments, modifications and improvements may be fairly presumed to be within the spirit, scope and purview of the invention as defined by the subtended claims.

What is claimed is:

1. In a device for positioning a concrete railroad tie shoulder in a concrete railroad tie mold wherein said shoulder includes an upper sleeve portion with opposed peripheral edges and a lower shank portion integral thereto, the improvement comprising:

a concrete railroad tie mold;

an opening in the bottom of said mold sized to receive a shoulder sleeve downwardly therethrough;

mold support means adapted to provide space beneath said mold to receive said shoulder sleeve;

a pair of rotatable means, rotatable to upper or to lower positions, pivotally secured to said mold support means and adapted to engage the opposite peripheral edges of said shoulder sleeve;

means to selectively bias said rotatable means upwardly or downwardly; and block means to delimit downward movement of said shoulder, whereby pressure applied to said shoulder shank portion shifts said biased rotatable means from the upper position to the lower position to hold a shoulder sleeve in pressure contact with said block means.

2. The device of claim 1, wherein said mold is provided with mold positioning; and means to secure said mold positioning plates to said mold support means.

3. The device of claim 1, including a pair of rotatable pins secured in said mold support means and spaced outboard of said respective rotatable means, each of said gripping means being biased by a leaf spring having one end secured to said rotatable means and an opposite end secured to an adjacent rotatable pin.

4. The device of claim 3, wherein said leaf spring is adapted to selectively snap said rotatable means into an upper position or into a lower position.

5. The device of claim 3 or 4 wherein said leaf spring is bowed upwardly when said rotatable means is in the lower position and is bowed downwardly when said rotatable means is in the upper position.

6. The device of claim 1, wherein each of said rotatable means is selectively biased either up or down by a rod pivotally secured at one end to the outboard end of one of said rotatable means and having an opposite end in sliding engagement with sleeve means secured to said mold support means; and biasing means between said one end of said rod and said sleeve means.

7. The device of claim 6, wherein said rod is adapted to selectively snap said rotatable means into an upper position or into a lower position.

8. The device of claim 6, wherein said biasing means comprises coiled spring means.

9. The device of claim 1, wherein the inboard ends of said rotatable means are provided with sleeve gripping recesses.

10. In a device for positioning a concrete railroad tie shoulder in a concrete railroad tie mold wherein said gudgeon comprises an upper sleeve portion and a lower shank portion, the improvement comprising:

spacer plates adapted to elevate said tie mold;

a hole in said tie mold between said spacer plates;

rotatable plates pivotally secured on their outboard ends to said spacer plates;

means on the inboard ends of said rotatable plates adapted to seize the sleeve portion of said shoulder therebetween;

stop means to delimit downward movement of a shoulder upper sleeve portion through said hole;

leaf spring means secured to said spacer plates; and leaf springs secured between the outboard ends of said rotatable plates and said leaf spring means, said means being spaced predetermined distances from respective rotatable plates to bow said leaf springs upwardly when said rotatable plates are in a pivoted lower position and to bow said leaf spring downwardly when said rotatable plates are in a pivoted upper position.

11. In a device for positioning a concrete railroad tie shoulder in a concrete railroad tie mold wherein said gudgeon comprises an upper sleeve portion and a lower shank portion, the improvement comprising:

spacer plates adapted to elevate said tie mold;

a hole in said tie mold between said spacer plates;

rotatable plates pivotally secured on their outboard ends to said spacer plates;

means on the inboard ends of said rotatable plates adapted to seize the sleeve portion of said shoulder therebetween;

stop means to delimit downward movement of a shoulder upper sleeve portion through said hole; and rods pivotally connected at their inboard ends to the outboard ends of respective rotatable plates and with the outboard ends of said rods in sliding engagement with respective spacer plates, said rods being biased by coiled springs between the inboard ends of said rods and said respective spacer plates, whereby said coiled springs are in compression when said rotatable plates are pivoted upwardly and when said rotatable plates are pivoted downwardly.

* * * * *